United States Patent [19]

Beasley

[11] Patent Number: 4,877,014

[45] Date of Patent: Oct. 31, 1989

[54] TUBE ARRANGEMENT FOR HEAT EXCHANGER

[75] Inventor: John A. Beasley, Clarksville, Tenn.

[73] Assignee: American Standard Inc., New York, N.Y.

[21] Appl. No.: 144,971

[22] Filed: Jan. 19, 1988

[51] Int. Cl.[4] ..... F24H 3/00

[52] U.S. Cl. ..... 126/116 R; 126/109; 126/391

[58] Field of Search ..... 126/116 R, 119, 109, 126/102; 165/168, 76, 178; 285/189

[56] References Cited

U.S. PATENT DOCUMENTS

| | | | |
|---|---|---|---|
| 102,956 | 5/1870 | Miller | 126/119 |
| 949,621 | 2/1910 | Coleman | 126/119 X |
| 2,383,924 | 8/1945 | Way et al. | 122/182 R |
| 2,787,318 | 4/1957 | Wolfersperger | 122/182 R |
| 2,806,718 | 9/1957 | Cook et al. | 165/178 |
| 3,707,186 | 12/1972 | Zorrilla et al. | 165/178 X |
| 4,479,481 | 10/1984 | Ingersoll et al. | 126/109 X |
| 4,651,714 | 3/1987 | Granberg | 126/391 X |

*Primary Examiner*—Larry Jones

*Attorney, Agent, or Firm*—William J. Beres; David L. Polsley; Robert J. Harter

[57] ABSTRACT

A tube arrangement for a tube-type heat exchanger. The tube arrangement provides for the location of the tubes in the upper portion of the drum defining the combustion chamber of the heat exchanger. In one embodiment, four heat exchange tubes are provided, with two of the tubes disposed such that the axial center line of the tube lies across the horizontal center line of the heat exchanger drum, and with two tubes disposed entirely above the horizontal center line of the drum.

14 Claims, 7 Drawing Sheets

TUBE ARRANGEMENT FOR HEAT EXCHANGER

TECHNICAL FIELD

This invention generally pertains to tube-type heat exchangers and more specifically to the tube arrangement in gas-combusting furnace heat exchangers having an enclosure defining a combustion chamber and a plurality of heat exchange tubes disposed thereon.

BACKGROUND ART

In a typical furnace having a horizontally disposed drum-type combustion chamber with a plurality of heat exchange tubes disposed thereon, the heat exchange tubes are commonly disposed evenly across the end of the combustion chamber drum. For example, the disposition of heat exchanger tubes in a two-tube heat exchanger consists of a disposition with the center line of the tubes corresponding with the horizontal center line of the combustion chamber drum. In a typical heat exchanger tube arrangement with more than two tubes, the tubes will be evenly disposed with an equal number of heat exchange tubes above the horizontal center line and below the horizontal center line.

In efforts to increase the operating efficiency and fuel utilization of the heat exchanger in furnaces, it is common to find designs utilizing tubes of different number, diameter and disposition. However, these designs attempt to achieve a maximum efficiency at the expense of simplicity in design of the heat exchanger, resulting in increased difficulty and expense in manufacture and maintenance.

Therefore, it is an object of the present invention to provide a heat exchanger tube arrangement which provides an increased efficiency in operation.

Another object of the present invention is to provide a simple and cost effective heat exchange tube arrangement.

Yet another object of the invention is to provide an increased heat transfer ability in the heat exchanger of a furnace while providing the foregoing benefits.

These and other object of the invention will be apparent from the attached drawings and the Description of the Preferred Embodiment that follows hereinbelow.

SUMMARY OF THE INVENTION

The subject invention comprises a heat exchange tube arrangement for heat exchange tubes disposed upon an end of a horizontal drum-type combustion chamber for a gas-combusting furnace. The arrangement includes providing a plurality of heat exchanger tubes with at least the center lines of two of said tubes disposed upon the horizontal center line of the drum, and a majority of the heat exchange tubes disposed upon the upper portion of the combustion chamber drum.

DESCRIPTION OF THE PREFERRED EMBODIMENT

Figure 1:
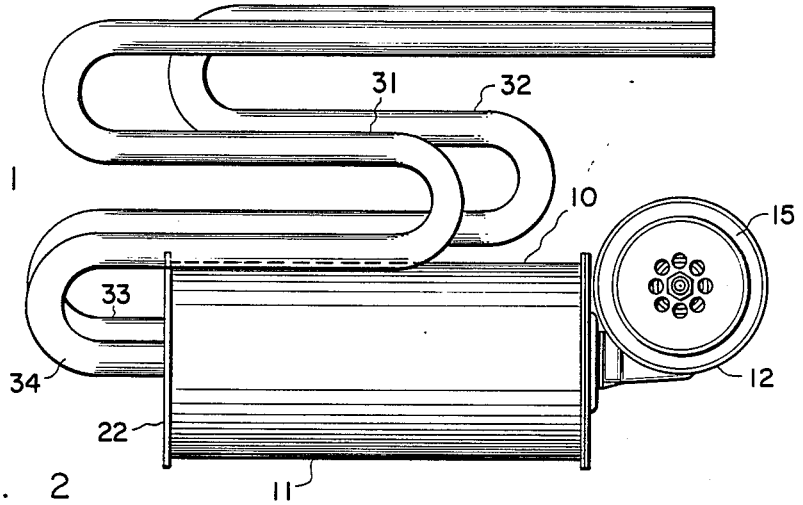
FIG. 1 shows a heat exchanger assembly.

A heat exchanger assembly 10 is generally shown in FIG. 1. Heat exchanger 10 includes a cylindrical drum-like combustion chamber enclosure 11 with a furnace burner assembly 12 disposed upon one end of the enclosure 11. The furnace burner assembly 12 includes a hot surface ignitor, a premixing chamber 15 with a fan impeller disposed therein. The fan impeller is driven by a fan motor. Furnace burner assembly 12 is shown in generally disclosed for the purpose of illustrating the operation of the heat exchanger assembly 10, and the details of the furnace burner assembly 12 are not disclosed herein as their form and function are well understood and not part of the subject invention. It is to be understood, therefore, that the furnace burner assembly 12 disclosed is not intended as a limitation upon the use of the subject invention, but rather describes the furnace burner assembly as generally used in the preferred embodiment of the heat exchanger.

Heat exchanger assembly 10 also includes a combustion chamber end plate 22 secured on the distal end of the combustion chamber enclosure 11 in a sealing gas tight fashion. In the preferred embodiment, four heat exchange tubes 31 through 34 each include a respective first end securably mounted upon the end plate 22. The heat exchange tubes 31 through 34 are serpentine tubes making three passes generally parallel to the combustion chamber enclosure 11 and concluding in second exhaust ends. Embodiments of heat exchange members other than tubes may be employed, but tubes are used in the preferred embodiment.

The combustion chamber enclosure 20 is generally horizontally disposed, although there may be a slight inclination in its disposition, and hence the heat exchange tubes 31 through 34 as disclosed pass above the combustion chamber enclosure 20. It is again understood that other dispositions and arrangements of the combustion chamber enclosure and heat exchange tubes are equally acceptable.

The end plate 22 includes an upper portion disposed above a horizontal line taken through the center line of the end plate 22, and a lower portion disposed below the upper portion. In the preferred embodiment, the upper portion includes the entire upper half of the end plate 22, defined as that portion disposed above the horizontal line taken through the end plate 22 center line. The heat exchange tubes are disposed with the majority, meaning more than one-half, of the number of heat exchange tubes employed in the upper portion of the end plate 22. The end plate 22, as shown in FIG. 1, is preferably planar or substantially planar, but may also in alternative embodiments be concave or convex with respect to the combustion chamber 20. The end plate 22, as noted above, directly covers over and sealingly encloses the combustion chamber enclosure 20 such that there is direct communication between the heat exchange tubes 31 through 34 and the combustion chamber.

Figure 2:
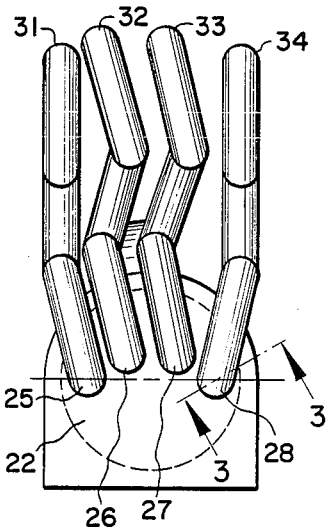
FIG. 2 shows an end view of the heat exchanger assembly.

In FIG. 2, the arrangement of heat exchanger tubes 31 through 34 upon end plate 22 is more fully set forth. A portion of the first end of each heat exchange tube 31 through 34 inserted a substantially short distance into an edge in the end plate 22 defining an exhaust aperture 25 through 28, respectively. The apertures 25, 26, 27 and 28 are defined through the end plate 22 to permit flow communication from the combustion chamber of drum 11 to the heat exchange tubes 31, 32, 33 and 34.

The first parallel pass of the heat exchange tubes 31 through 34 is displaced a selected distance vertically from a horizontal line drawn through the center line of the combustion chamber enclosure 11, and the subsequent passes of heat exchange tubes 31 through 34 are then made at the same relative separation. In the preferred embodiment, the passes made by the heat exchange tubes 32 and 33 also undulate from side to side with respect to a vertical line drawn through the center of the combustion chamber enclosure 20.

In operation of the preferred embodiment, a combustible gas and air enter the premixing chamber 15 and are mixed and forced by the fan impeller driven by the fan motor from the furnace burner assembly 12 into the combustion chamber volume of the combustion chamber enclosure 11. The mixture of combustible gas and air from the furnace burner assembly 12 passed the hot surface ignitor and are thereby ignited to combustion within the combustion chamber. The heat exchanger tubes 31 through 34 are in flow communication with the combustion chamber to exhaust the heated combustion gas by-products from the combustion chamber through the interior of the heat exchange tubes 31 through 34, thus effecting heating of the heat exchange tubes and the space thereabout by virtue of a transfer of heat from the combusted gas and air mixture to the heat exchange tubes.

As the mixture passes through and is combusted in the combustion chamber, the combustion by-products of relatively higher temperature tend to rise toward the upper portion of drum 11 corresponding with that of end plate 22. The end plate 22 is disposed directly on the end of the drum 11, comprising the limit of and sealingly enclosing the combustion chamber defined by the drum 11, the furnace burner assembly 12, and the end plate 22. It is these higher temperature by-products which are exhausted through the heat exchange tubes 31 through 34. This higher temperature exhaust increases the thermodynamic efficiency of the heat exchanger assembly 10.

Figure 3:
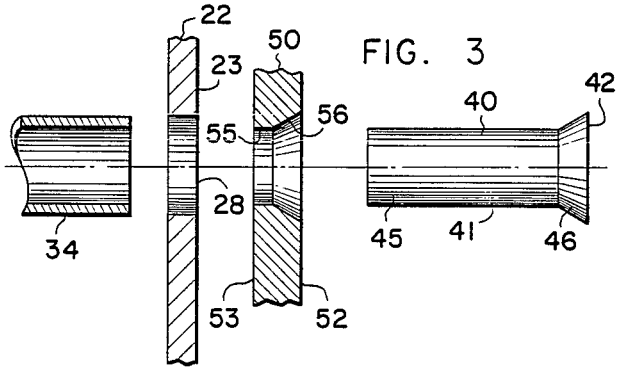
FIG. 3 shows an exploded cross-sectional view of the heat exchange tube and drum end plate subassembly taken through line 3—3 of FIG. 2.

FIG. 3 shows an exploded cross-sectional view of the heat exchange tube through line 3—3 of FIG. 2, disclosing the preferred embodiment of the means by which each heat exchange tube 31 through 34 is placed in flow communication with the combustion chamber of the combustion chamber enclosure 11. This is accomplished by means of a tubular flow member 40, which includes a cylindrical portion 41 and a conical frustum portion 42 coaxial with the cylindrical portion 41. The interior of the tubular flow member 40 permits flow communication therethrough also coaxially with the cylindrical portion 41. The cylindrical portion 41 includes an outer surface 45 and the frustum portion 42 includes an outer surface 46.

An insulating plate 50, comprised preferably of a refractory-type insulating material, cooperates with the tubular flow member 40. The insulating plate 50 has an inner plate surface 52 and an outer plate surface 53 and bores therethrough defined by a cylindrical bore surface 55 and a frustoconical bore surface 56. The number and location of bores correspond to the number and placement of the exhaust apertures 25, 26, 27 and 28.

During assembly, the cylindrical outer surface 45 slidingly engages the cylindrical bore surface 55, and the tubular flow member 40 is inserted through the insulating plate 50 until the frustum outer surface 46 firmly engages the frustoconical bore surface 56.

Each heat exchange tube 31 through 34 (shown) is inserted into an exhaust aperture 25 through 28 (shown) in order, i.e., heat exchange tube 31 into exhaust aperture 25, to a position adjacent an inner end plate surface 23 of the combustion chamber end plate 22. The heat exchange tubes 31 through 34 are positionally secured in a gas-tight manner, such as by welding, to the end plate 22. The outer plate surface 53 is then placed against the inner end plate surface 23 such that the cylindrical portion 41 of each tubular flow member 40 projects centrally through a respective exhaust aperture 25 through 28 (shown) and into concentric engagement in the respective heat exchange tube 31 through 34 (shown).

It is understood that each embodiment of the subject invention described herein preferably includes an insulating plate 50 with bores defined by apertures corresponding in size, number and location to those defined in the end plate 22 of each respective embodiment, although the insulating plate 50 need not be present for the proper operation of the subject invention.

It is also to be understood that the foregoing is set forth to clarify the operation and assembly of the subject invention in its preferred embodiment, and is not to be understood by way of limitation. Other means of securing the heat exchanger tubes in a flow communicating manner, such as by welding or clamping would be equally acceptable to the understanding of the subject invention.

Figure 4:
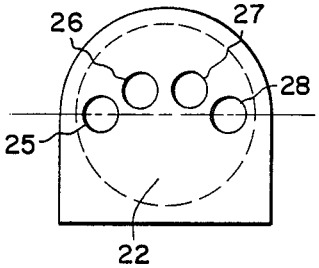
FIG. 4 shows the disposition of apertures in the drum end plate in the preferred embodiment.

Turning now to FIG. 4, the preferred embodiment of the arrangement of heat exchange tubes 31 through 34 upon end plate 22 is more particularly disclosed. Four apertures through end plate 22 are defined by openings having edges 25, 26, 27 and 28 through the end plate 22. Circular openings with edges 25 and 28 have center lines which are horizontally disposed equal to the center line of the combustion chamber enclosure 20. Circular openings defined by edges 26 and 27 are set with their respective center lines located above the horizontal plane of the center line of combustion chamber enclosure 20.

Figure 5:
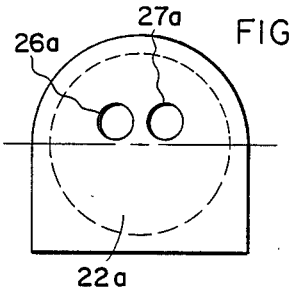
FIG. 5 shows an alternative embodiment of the present invention.

FIG. 5 discloses an alternative embodiment for the arrangement of heat exchanger tubes according to the present invention in a heat exchanger utilizing only two heat exchanger tubes. Apertures are defined through an end plate 22*a* by circular openings defined by edges 26*a* and 27*a*. The center lines of the circular openings are located such that edges 26*a* and 27*a* are disposed entirely above the horizontal center line of combustion chamber enclosure 20*a* in the upper portion of end plate 22*a*.

Figure 6:
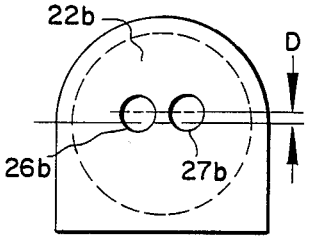
FIG. 6 shows another alternative embodiment of the present invention.

A variation of the foregoing alternative embodiment is disclosed in FIG. 6. In this alternative embodiment, the circular edges 26*b* and 27*b* are located with center lines slightly above the horizontal center line of combustion chamber enclosure 20*b*, by a distance D. This distance dimension D may be, for example, one-half inch, such that the majority of the circular opening and thus a heat exchange tube communicating therewith is located above the horizontal center line of the combustion chamber enclosure 20*b*.

Figure 7:
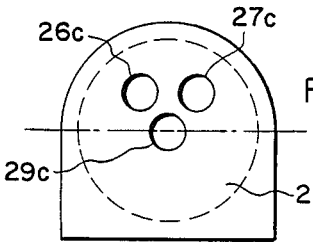
FIG. 7 shows yet another alternative embodiment of the present invention.

FIG. 7 discloses an alternative embodiment for the arrangement of three heat exchange tubes. Circular openings defined by edges 26c and 27c are located in the positions described for the embodiment set forth in FIG. 3, however, an additional circular opening defined by edge 29c is located upon the vertical center line of the combustion chamber enclosure 20. The horizontal center line of circular opening 29c is located upon or above the horizontal center line of the combustion chamber enclosure 20c.

The operation of the heat exchanger assembly 10, whether in the preferred embodiment as shown in FIGS. 1 through 4 or in the alternative embodiments set forth in FIGS. 5, 6 and 7, is substantially the same as that set forth previously. The inventive feature of the subject invention lies with the disposition of the heat exchanger tubes and apertures in the end plate 22. The improvement in the disposition of apertures 25 through 28 and heat exchange tubes 31 through 34 in end plate 22 provides an inexpensive and easily implemented means for increasing the efficiency of heat exchanger assembly 10. It will be appreciated that the disposition of apertures 25 through 28 and heat exchanger tubes 31 through 34 set forth herein provide substantial advantages over the known prior art.

Modifications to the preferred embodiment of the subject invention will be apparent to those skilled in the art within the scope of the claims that follow.

I claim:

1. A heat exchanger comprised of:

a generally horizontally disposed drum defining a substantially cylindrical combustion chamber with an end thereon having an upper portion and a lower portion, said end directly covering over and enclosing said combustion chamber, said end further having a plurality of apertures therethrough, with a majority of said apertures defined in the upper portion of said end;

a plurality of heat exchange members connected to said end for flow communication with said combustion chamber through said apertures of said end so as to improve ignition and combustion characteristics of the heat exchanger.

2. The heat exchanger as set forth in claim 1 wherein said end is substantially circular, having a plurality of apertures therethrough in the upper portion thereof and a plurality of heat exchange members connected to said end in sealing engagement, each said aperture providing flow communication with said combustion chamber and a respective one of said plurality of heat exchange members.

3. The heat exchanger as set forth in claim 2 wherein the upper portion of said end is the upper half thereof.

4. The heat exchanger as set forth in claim 3 wherein said heat exchange members are tubular and serve to exhaust combustion by-products from said combustion chamber.

5. A drum and tube heat exchanger comprised of:

a drum defining a substantially cylindrical, generally horizontally disposed combustion chamber;

an end plate sealingly secured to an end of said drum, said end cover having an upper portion and a lower portion thereof and a plurality of apertures therethrough, the majority of said apertures being in said upper portion of said end cover;

a plurality of tubular heat exchange members cooperating with said apertures in a flow communication manner to transfer heat from said combustion chamber and to exhaust combustion by-products from said combustion chamber therethrough.

6. The heat exchanger as set forth in claim 5 wherein the upper portion of said end cover comprises the upper half thereof.

7. The heat exchanger as set forth in claim 6 wherein said end cover further includes means for attaching said heat exchange members to said end cover such that each said heat exchange member cooperates with one said aperture in said end cover to transfer heat to a heat exchange space.

8. The heat exchanger as set forth in claim 7 wherein said drum is further comprised of a burner disposed in said drum for controlled combustion of air and a combustible substance whereby heat is generated in said combustion chamber.

9. A drum and tube heat exchanger comprised of:

a drum defining a substantially cylindrical combustion chamber, said drum having at least one end thereon;

an end plate sealingly secured to the end of said drum, said end plate having a plurality of circular apertures therethrough, each said aperture having a respective center line, said end plate having said apertures disposed therein with the majority of said apertures center lines located in the upper half of said end plate above the end plate center line;

a plurality of tubular heat exchange members, each said heat exchange member having a first end sealingly secured in a gas-type manner to a respective said aperture in said end plate for flow communication from said combustion chamber to said heat exchange member, whereby said heat exchange members transfer heat from said combustion chamber and exhaust combustion by-products from said combustion chamber.

10. The drum and tube heat exchanger as set forth in claim 9 wherein said plurality of circular apertures is further comprised of two said circular apertures disposed entirely in the upper half of said end plate and at least one said circular aperture having a center line located upon said end plate center line.

11. The drum and tube heat exchanger as set forth in claim 9 wherein said plurality of circular apertures are disposed in said end plate with all of said respective apertures having the respective aperture center lines located above said end plate center line.

12. A method of improving ignition and combustion in a drum and tube heat exchanger, comprising the steps of securing an end plate upon an end of a substantially cylindrical drum defining a combustion chamber; providing a plurality of apertures in an upper portion of said end plate; attaching a plurality of heat exchange members to said end plate in a flow communicating manner with said apertures.

13. The method as set forth in claim 12 wherein the step of providing a plurality of apertures in said end plate is further comprised of providing a plurality of said apertures in an upper half of said end plate.

14. The method as set forth in claim 13 wherein the step of providing a plurality of apertures in said end plate is comprised of providing two apertures upon a center line defined in said end plate and providing two apertures disposed above the center line defined in said end plate.

* * * * *